US006395108B2

(12) United States Patent
Eberle et al.

(10) Patent No.: US 6,395,108 B2
(45) Date of Patent: May 28, 2002

(54) FLAT PRODUCT, SUCH AS SHEET, MADE OF STEEL HAVING A HIGH YIELD STRENGTH AND EXHIBITING GOOD DUCTILITY AND PROCESS FOR MANUFACTURING THIS PRODUCT

(75) Inventors: Klaus Eberle, Gäufelden (DE); Philippe Harlet, Ransart; Pierre Cantinieaux, Thy-le-Château, both of (BE)

(73) Assignee: Recherche et Developpement du Groupe Cockerill Sambre, Liege ( * ) Notice: Subject to any disclaimer, the term of this patent is extended or adjusted under 35 U.S.C. 154(b) by 0 days.

(21) Appl. No.: 09/843,826

(22) Filed: Apr. 30, 2001

Related U.S. Application Data

(63) Continuation of application No. 09/743,287, filed as application No. PCT/BE99/00088 on Jul. 7, 1999, now abandoned.

(30) Foreign Application Priority Data

Jul. 8, 1998 (EP) ..... 98202377
Nov. 19, 1998 (EP) ..... 98870255

(51) Int. Cl.[7] ..... C22C 38/04; C22C 38/32; C22C 38/54; C21D 8/02

(52) U.S. Cl. ..... 148/330; 148/332; 148/333; 148/336; 148/602; 148/603; 148/648; 148/653; 148/651; 148/654; 148/663

(58) Field of Search ..... 148/533, 602, 148/603, 648, 651, 653, 654, 661, 663, 320, 330, 332, 333, 334, 336

(56) References Cited

U.S. PATENT DOCUMENTS 4,426,235 A 1/1984 Sudo et al.
4,544,422 A 10/1985 Rao
4,854,976 A 8/1989 Era et al.
5,328,528 A 7/1994 Chen
5,470,529 A 11/1995 Nomura et al.

FOREIGN PATENT DOCUMENTS

EP 0 040 553 11/1981
EP 0 320 003 6/1989

OTHER PUBLICATIONS

Haidemenopoulos G N et al : "Modelling of austenite stability in low–alloy triple–phase steels" Steel Research, vol. 67, No. 11, (1996), pp. 513–519,XP–002072281.

Haidemenopoulos G N: "Austenite stabilization from direct cementite conversion in low–alloy steels" Steel Research, vol. 67, No. 3, Mar. 1996, pp. 93–99, XP002072282 cited in application.

Patent Abstracts of Japan vol. 095, No. 004, May 31, 1995 & JP 07 003328 A ( Sumitomo Metal Ind Ltd ), Jan. 6, 1995 abstract.

Patent Abstracts of Japan 06017188, Jan. 25, 1994 ( NKK Corp ) Hirano Osamu abstract.

Patent Abstracts of Japan 02149646, Jun. 8, 1990 ( Kobe Steel Ltd ) Kobe Shigenobu abstract.

Patent Abstract of Japan 06145788, May 27, 1994 ( Nippon Steel Corp ) Matsumura Giichi.

Patent Abstracts of Japan 06145892, May 27, 1994 ( Nippon Steel Corp. ) Matsumura Giichi, abstract.

*Primary Examiner*—Deborah Yee
(74) *Attorney, Agent, or Firm*—Pillsbury Winthrop LLP

(57) ABSTRACT

A flat product made of multiphase steel and a method for preparing the steel includes hot rolling at a temperature at which the austenite phase is stable, then tempering to form a C and Mn-enriched phase in a matrix, followed by a heat treatment to form austenite islands and/or enriching in Mn the already formed austenite and cooling down to room temperature so as to obtain a final product with a ferrite matrix containing residual austenite, bainite and/or martensite islands.

36 Claims, 10 Drawing Sheets

FLAT PRODUCT, SUCH AS SHEET, MADE OF STEEL HAVING A HIGH YIELD STRENGTH AND EXHIBITING GOOD DUCTILITY AND PROCESS FOR MANUFACTURING THIS PRODUCT

CROSS REFERENCE TO RELATED APPLICATIONS

This application is a continuation of Ser. No. 09/743,287 filed Jan. 8, 2001, now abandoned which is a 371 of PCT/BE99/00088 filed Jul. 7, 1999.

This application claims benefit of and priority from: European Applications No. 98202377.2 filed Jul. 8, 1998 and No. 98870255.1 filed Nov. 19, 1998; International Application No. PCT/BE99/00088 filed Jul. 7, 1999; and U.S. application Ser. No. 09/743,287 filed Jan. 8, 2001, the contents of all of which are incorporated hereinto by this reference.

The present invention relates to a flat product, such as a sheet, made of steel containing Mn and having multiple phases with a ferrite matrix.

BACKGROUND OF THE INVENTION

High-strength steels such as rephosphorized steels, microalloy steels and bake-hardening steels are widely used in automobile components. Sheet made of such a steel requires a strength sufficient to meet automobile safety and must, in addition, have excellent forming properties.

It is also known that the strength and ductility of a multiphase steel may be improved by a multiphase microstructure possibly combined with transformation-induced plasticity (TRIP) by transformation of residual austenite into martensite.

The TRIP effect was first discovered by Zackay et al. in steels containing large amounts of nickel and chromium.

However, the presence in these steels of large amounts of such alloying elements poses problems when manufacturing steels under economically profitable conditions.

It should also be pointed out that a steel containing a significant amount of residual austenite may be obtained by the addition of silicon and of manganese and by hot rolling with a controlled heat cycle or by cold rolling followed by intercritical annealing combined with a bainitic soak producing a structure formed from several phases and with isolated regions or islands of residual austenite, this structure being stable at room temperature.

Such a steel is known in particular from document U.S. Pat. No. 4,544,422 and from the articles by Gregory H. Haidemonopoulos "Austenite stabilisation from direct cementite conversion in low-alloy steels" in *Steel Research* 67 (1996) No. 3, pp 93–99 and "Modelling of austenite stability in low-alloy triple-phase steels", *Steel Research* 67 (1996) No. 11, pp 513–519.

However, these known steels and their smelting have a number of not-insignificant drawbacks since, in general, they require large amounts of addition elements.

In addition, the fact that in these known steels the silicon content is generally relatively high, about 1.25 to 1.50% of Si, gives a steel sheet having certain surface defects called "cat's tongue" defects which are created during the hot rolling. Moreover, these known steels pose problems when dip-coating them with metal, such as during galvanizing, due to the embrittlement of the coating and to problems of wettability of the liquid metal intended to form the coating.

SUMMARY OF THE INVENTION

One of the essential objectives of the present invention is to provide a steel sheet which makes it possible to remedy the abovementioned drawbacks and which, thus, is particularly well suited for galvanizing while still being able to be manufactured according to an economically very favorable process.

According to the invention, the steel has improved strength and ductility properties while still having an extremely low silicon content, so that it is very particularly suitable for being formed and for being surface-treated in the automobile industry.

For this purpose, the steel sheet according to the invention has a structure and properties which can be obtained by a process as defined in claim 1.

Advantageously, the steel according to the invention has the following chemical composition: 0.05 to 0.8% C; 0.2 to 3.0% Mn; Si≦1.0%; B≦0.100%; Ti, Nb, Zr and V each≦0.200%; Al≦0.400%; N≦0.100%; P≦0.100%; Cr, Ni and Cu each≦2.000%; Mo≦0.500%.

The invention also relates to the particular aforementioned process for the manufacture of the flat steel product according to the invention.

According to one particular method of implementing this process, the aforementioned tempering is carried out at a temperature below the eutectoid temperature ($A_1$) so as to form cementite and to make carbide-forming elements, such as Mn, to diffuse into this cementite.

According to a preferred method of implementation, the process according to the invention comprises a step of cooling down to room temperature after the aforementioned soak or tempering step, this step then being followed by a cold-rolling step before the aforementioned heat-treatment step.

Further details and features of the invention will become apparent from the description given below, by way of nonlimiting example, of a few particular embodiments of the invention with reference to the appended drawings.

AILED DESCRIPTION OF PREFERRED EMBODIMENTS

Figure 1:
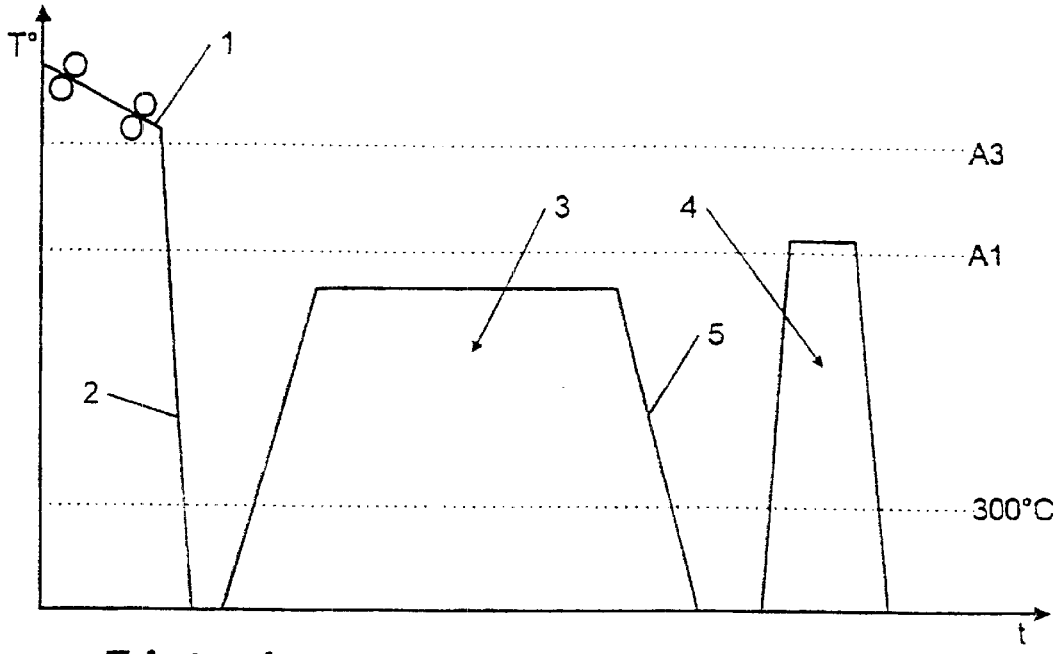
FIGS. 1 to 15 relate to schematic graphs of the temperature in ° C. in which steel is treated as a of its treatment time, illustrating the steps of the process according to the invention.

In the various figures, the same reference number denote similar or identical elements.

In general, the invention relates to a multiphaese steel preferably in the form of a sheet and comprising a ferrite matrix in which islands of residual austenite are distributed, which matrix is also stable at room temperature and which possibly exhibits transformation-induced plasticity (TRIP) and possibly furthermore islands of bainite and/or of martensite. In addition, the ferrite matrix may be reinforced with secondary precipitates of the microalloying elements.

From the chemical standpoint, this steel may contain 0.05 to 0.8% carbon, 0.2 to 3.0% manganese and less than 1% silicon. However, according to the invention, preference is given to steels containing the least possible silicon, for example less than 0.5%, preferably at the very most 0.4% or even less than 0.2%.

In addition to the aforementioned elements, this steel may have an intentionally adjusted low content of boron, titanium, niobium, zirconium, vanadium, aluminum, nitrogen, phosphorus, chromium, nickel, copper, molybdenum and traces of impurities generally inevitable in the production of steel, the balance being iron.

More particularly, for the steel according to the invention, the concentration o f the aforementioned various elements is advantageously as follows: B≦0.100%; Ti, Nb, Zr and V each≦0.200%; Al≦0.400%; N≦0.100%; P≦0.100%; Cr, Ni and Cu each ≦2.000%; Mo≦0.500%.

As already mentioned above, the invention also relates to a process for the manufacture of a sheet of multiphase steel satisfying the aforementioned chemical composition, in which process this steel, for example in the form of a slab, is subjected to the following successive steps:

hot-rolling of this steel at a temperature at which the austenitic phase is stable, i.e. at a temperature above the austenite transformation temperature ($A_3$);

a soak or tempering of the coiled sheet at a temperature of between 300° C. and a temperature 50° C. above the eutectoid temperature ($A_1$) for at least 4 hours, optionally followed by cooling down to room temperature, so as to form a phase enriched with carbide-forming and/or gammagenic elements, such as C and Mn, in a ferrite matrix;

heat treatment at a temperature above the aforementioned eutectoid temperature ($A_1$) and below the austenite formation temperature ($A_3$) so as to form islands of austenite and/or to enrich the austenite already formed with gammagenic elements, such as Mn; and subsequent cooling down to room temperature in such a way as to obtain a final product having a ferrite matrix containing islands of residual austenite.

The aforementioned heat treatment may be preceded or followed by cold rolling.

In fact, the invention consists in producing a steel containing simultaneously at least two phases such as ferrite/residual austenite and ferrite/bainite, ferrite/martensite, ferrite/bainite/martensite with residual austenite and a very low silicon content, having, in addition, a structure and properties of a steel obtained by the process as defined above.

In this process, three important successive steps may in general be detected.

In the first step, a steel, satisfying the aforementioned chemical composition, is hot-rolled above the temperature $A_3$, which is the temperature at which austenite is transformed into ferrite and which depends on the chemical composition of the steel. The slab reheat takes place at temperatures of 1100° C. to 1350° C. for 130 to 250 minutes. This step may be regarded as the austenization step during which the formation of ferrite and pearlite is prevented and in which the C and Mn are kept in solution. The hot rolling comprises rough rolling followed by finish rolling, which take place at a temperature above the temperature $A_3$.

Optionally, this hot rolling may then be followed by cooling down to room temperature in such a way as to form a microstructure comprising bainite and/or martensite, while preventing the formation of ferrite and pearlite.

Preferably, this cooling takes place, at least partially, on a runout table or by using an accelerated cooling tool called "ultrafast cooling".

In the second step, after the sheet obtained by the aforementioned rolling has been coiled, during which the sheet continues to cool, and after the pickling, the tempering takes place which, for example, may be carried out by heating in a bell annealing furnace up to a temperature lying between 300° C. and 50° C. above the eutectoid temperature $A_1$. This temperature is maintained for at least 4 hours and preferably at the very most for 200 hours.

For several thermomechanical pathways developed, there is a combination of hot rolling followed directly by a soak or tempering without the sheet being cooled to room temperature.

During the soak or tempering, the flat product is still covered on the surface with an iron oxide called "millscale".

The advantages encountered with millscale during the soak or tempering are the following: no problem of the cones sticking together during the soak or tempering and no problem of the surface of the sheet decarburizing, even without the use of a reducing atmosphere in the isolating bell or in the annealing bell.

In the third step, a heat treatment is carried out at a temperature above the eutectoid temperature $A_1$ but below the austenite formation temperature $A_3$.

This heat treatment may be carried out directly after the tempering or after cooling possibly combined with cold rolling. In any case it is followed by controlled cooling down to room temperature. The main purpose of this operation is to obtain a final product having a ferrite matrix containing islands of residual austenite and possibly furthermore of bainite and/or martensite. The relative amount of these phases depends essentially on the initial chemical composition of the steel treated and on the particular conditions under which the various steps are performed.

More particularly, the C content determines the maximum volume of ferrite and makes it possible to significantly reduce the martensite start temperature $M_s$, given by the formula:

$$M_s=539-423\times C-30.4\times Mn-7.5\times Si \qquad \text{(Andrews' formula)}$$

The C content controls the start time in a continuous cooling diagram and the ferrite and bainite formation kinetics.

Thus, choosing the C content allows a martensite and/or bainite microstructure to be obtained during the cooling on a runout table or using an accelerated cooling device called "ultrafast cooling".

Carbon is an interstitial element which hardens the ferritic phases in the steel. In a tempered microstructure, a phase rich in carbon, called "iron carbide" or "cementite" is formed. The fraction of this phase formed may be controlled by the carbon content. Manganese is known as an element which increases the hardenability of a steel and as a substitution element which hardens the ferrite phases in the steel. Manganese may be enriched by an exchange reaction in iron carbides (substitution of iron with manganese) during a tempertreatment.

The choice of manganese content makes it possible to influence the bainite formation region in a continuous cooling diagram and in the isothermal soak diagram. Manganese makes it possible to reduce the temperature at which martensite starts to form and, consequently, to improve the stability of the austenitic phase.

Silicon is a substitution element which hardens the ferritic phases in the steel. It is alpha-genic, which means that it increases the temperature of ferrite formation during cooling. At a higher Si content, certain surface defects called "cat's tongue" defects, which are created during the hot rolling, may appear. Moreover, these known steels pose problems when dip-coating them with metal, such as during galvanizing, due to the embrittlement of the coating and to problems of wettability of the liquid metal intended to form the coating.

The silicon stabilizes the carbon in solution in the austenite and in the bainite by inhibiting the precipitation of cementite. This effect is explained by the fact that silicon is relatively insoluble in cementite, which requires controlled ejection, by diffusion, of silicon in the transformation front. This results in inhibition of the growth of cementite embryos.

The elements consisting of niobium, vanadium, zirconium and titanium, by themselves or in a combination, are used in a small amount to form carbides, nitrides or carbonitrides so as to be able to stop grain growth during the slab reheat and to be able to increase the strength by the precipitation effect.

During the hot rolling and during the cooling on the runout table and/or in the coil after coiling, a strength-increasing effect may take place by the precipitation effect.

In the nonprecipitated state, that is to say in the state in solution in the crystalline ferrite lattice, the microalloying elements may provide a strength-increasing effect by secondary precipitation during a tempering treatment.

Aluminum is used to fix the nitrogen in solution, by forming aluminum nitrides. Aluminum nitrides have, in addition, a positive effect by reducing the austenite grain growth up to a temperature of about 1150° C. during the reheating of the steel as it is being hot rolled.

Aluminum is a substitution element which hardens the ferritic phases in the steel and stabilizes the carbon in solution in the austenite and in the bainite by inhibiting the precipitation of cementite. This effect is explained by the fact that aluminum is relatively insoluble in cementite, which requires the controlled ejection, by diffusion, of aluminum in the transformation front. This inhibits the growth of cementite embryos.

Phosphorus has a positive effect on the strength of the steel, but its content must also be kept quite low in order to prevent embrittlement effects. Nitrogen is an impurity whose content must also be kept as low as possible.

Nitrogen is an interstitial element which hardens the ferritic phases in the steel and, in solution in the steel, increases the aging sensitivity.

In very small amounts, boron is deposited at the grain boundaries and thus increases ductility. Boron also impairs the formation of the phases which are obtained by diffusion, such as the ferrite and pearlite phases. Boron increases the hardenability of the steel during hot rolling. Boron forms precipitates with the nitrogen in solution.

At a temperature at which bainite formation takes place, boron reduces the bainite formation kinetics. The boron may be enriched by an exchange reaction in the iron carbides (substitution of the carbon with boron) or by coupled precipitation of the iron borocarbides and iron carbides during a tempering treatment at a sufficient activation temperature.

Molybdenum is a substitution element; it hardens the ferritic phases in the steel. Molybdenum is known as an element which increases the hardenability of a steel. The molybdenum may be enriched by an exchange reaction in the iron carbides (substitution of iron with molybdenum) or by coupled precipitation of iron carbides with molybdenum carbides during a tempering treatment at a sufficient activation temperature.

Chromium is a substitution element which hardens the ferritic phases in the steel. Chromium is known as an element which increases the hardenability of a steel and can be enriched by an exchange reaction in the iron carbides (substitution of iron with chromium) or by coupled precipitation of iron carbides with chromium carbides during a tempering treatment at a sufficient activation temperature.

Nickel and copper are substitution elements which harden the ferritic phases in the steel and which are known as elements which increase the hardenability of a steel.

Let us also point out that a heat treatment, such as a tempering or annealing treatment, at a temperature lying between the temperature $A_1$ and the temperature $A_3$ is called "intercritical annealing or tempering".

Mention may be made in certain steps of the process described above, and in certain particular methods of implementing this process explained below, of so-called "slow" cooling, so-called "rapid" cooling and/or so-called "accelerated" cooling.

In general, "slow cooling" generally corresponds to decreasing the temperature by 10° C. to 40° C. per hour, depending on the thickness of the sheet, on the composition of the steel and on the initial temperature of the sheet.

On the other hand, "rapid cooling", which in general takes place by means of a fluid, generally corresponds to decreasing the temperature by 10° C. to 300° C. per second, depending on the thickness of the sheet, on the composition of the sheet and on the initial temperature of the sheet.

Accelerated cooling, by quenching the wound coil in a liquid, generally corresponds to decreasing the temperature at a rate of greater than 10° C. per minute.

The graphs shown schematically in FIGS. 1 to 15 illustrate a few particular methods of implementing this process, which is applied to a slab or ingot of steel which has the aforementioned composition and has been reheated to temperatures of 1100° C. to 1350° C. for 130 to 250 minutes.

In the first method of implementation according to FIG. 1, after the first step, which comprises hot rolling in the austenitic range above the temperature $A_3$, represented by the straight line in segment 1, followed by cooling, represented by the straight line segment 2, in order to obtain a quenched bainite and/or martensite structure, and in the second step, formed by the tempering, represented by the reference 3, which takes place by "bell" annealing at a temperature of between 300° C. and the temperature $A_1$, for at least 4 hours, a sheet is obtained which comprises iron carbides (cementite) into which the carbide-forming elements, such as Mn, have diffused, and more particularly cementite enriched with manganese, chromium, molybdenum and/or boron and possibly secondary precipitates formed by microalloying these elements in the ferrite matrix.

The term "bell" annealing should be understood to mean in fact discontinuous annealing carried out on a sheet wound as a coil in a furnace maintained at the desired temperature.

After slow or quench-accelerated cooling 5, the sheet has been subjected to the third step, which comprises the aforementioned heat treatment 4, corresponding either to continuous annealing in the temperature range lying between the temperature $A_1$ and the temperature $A_3$, preferably at the very most at 900° C., for 1 second to 5 minutes, or intercritical "bell" annealing in the aforementioned temperature range. During this annealing, the carbides (cementite) are transformed to austenite, the chemical composition of which will be enriched with the elements contained and the carbides, with nucleation of the austenite at the cementite/ferrite grain boundaries. This annealing is then followed by rapid cooling, tied to the conventional technology of continuous annealing, which is annealing of an uncoiled sheet, or by slow or quench-accelerated cooling which, in this case, may be carried out on a coiled sheet.

In the case of continuous annealing, strips of uncoiled sheet are butt-welded so as to obtain in practice a continuous strip. Thus, in such a case, the annealing time is extremely short and generally between a few seconds and a few minutes, whereas the bell annealing generally takes several hours. In the latter case, if necessary, quench-accelerated cooling may also be applied.

Moreover, if necessary, the millscale may be pickled before or after the aforementioned second step. The pickling may be carried out either by chemically etching the millscale in an acid bath or by reducing the millscale during annealing in a hydrogen-rich reducing atmosphere.

Finally, the sheet is either uncoated, or coated by electrochemically depositing metal on it or galvanized, for example after the sheet is formed.

Figure 2:
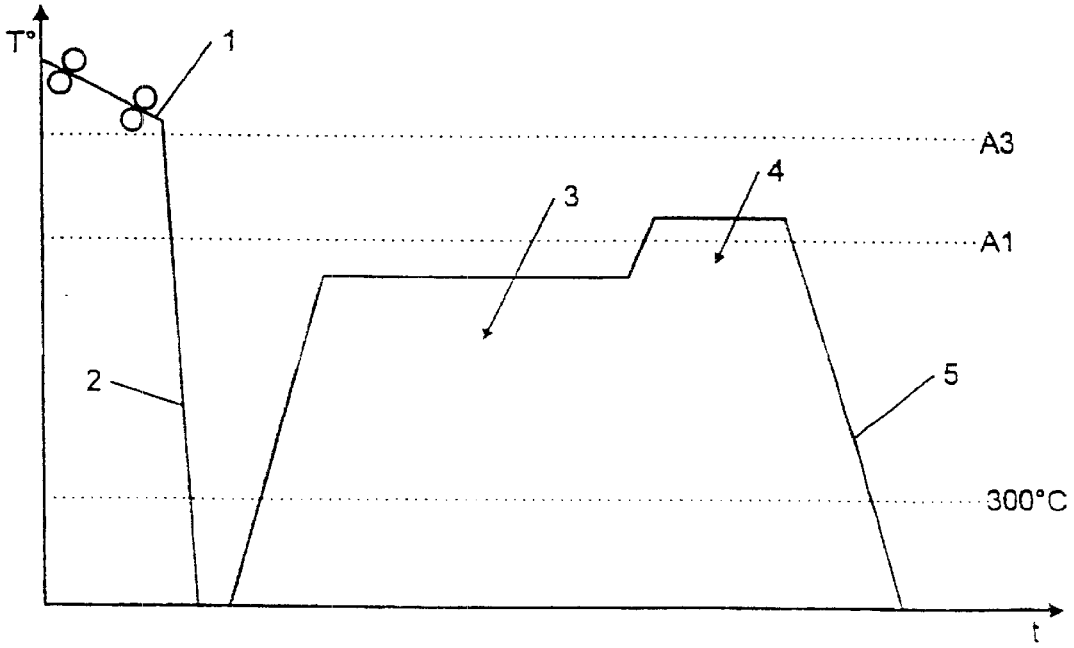

FIG. 2 shows a second method of implementing the process according to the invention, which is distinguished from that of FIG. 1 by the fact that the tempering 3 by bell annealing is carried out at a temperature below the temperature $A_1$ and is immediately followed by the heat treatment 4 consisting of intercritical tempering by bell annealing between the temperature $A_1$ and a temperature of 50° C. above this temperature $A_1$.

In this case, relatively slow heating may take place between the tempering 3 and the heat treatment 4, during which residual austenite also forms. This heat treatment 4 is then followed by cooling 5, which may be slow cooling generally associated with the conventional technology of bell annealing, or quench-accelerated cooling.

Figure 3:
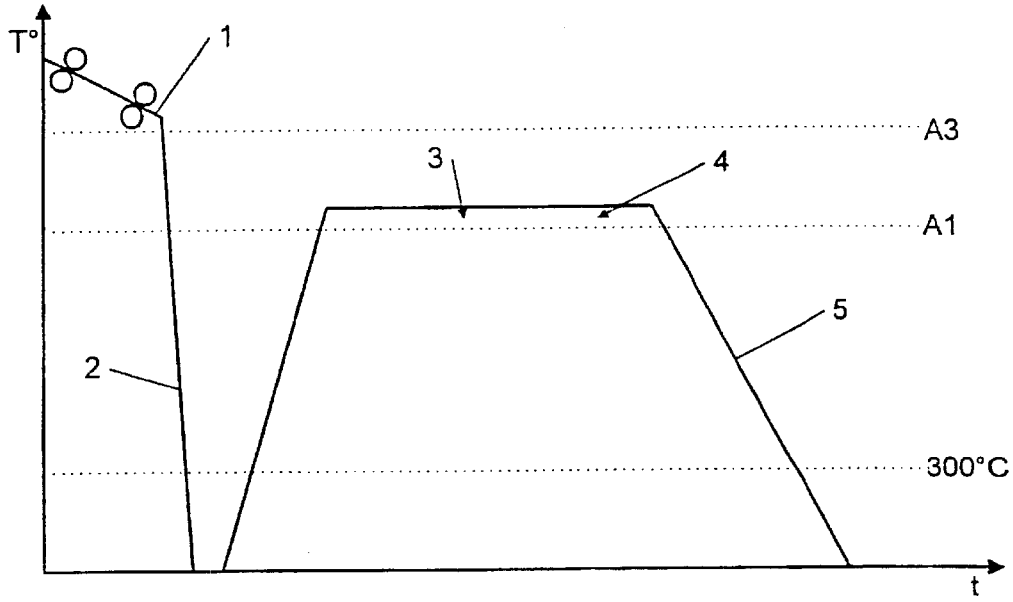

The third method of implementation, illustrated in FIG. 3, is distinguished from the previous two by the fact that the tempering 3, like the aforementioned heat treatment 4, takes place at the same temperature, which is above the temperature $A_1$ and below the temperature $A_1$+50° C., so as this way to constitute one and the same operation.

During the heating which precedes this operation, a microstructure starts to form which consists of fine cementite particles with nuclei for austenite seeds during the austenization at the temperature of the tempering 3 and of the heat treatment 4. As in the previous method of implementation, this operation is then followed by slow or accelerated cooling 5, as in the two previous methods of implementation.

Figure 4:
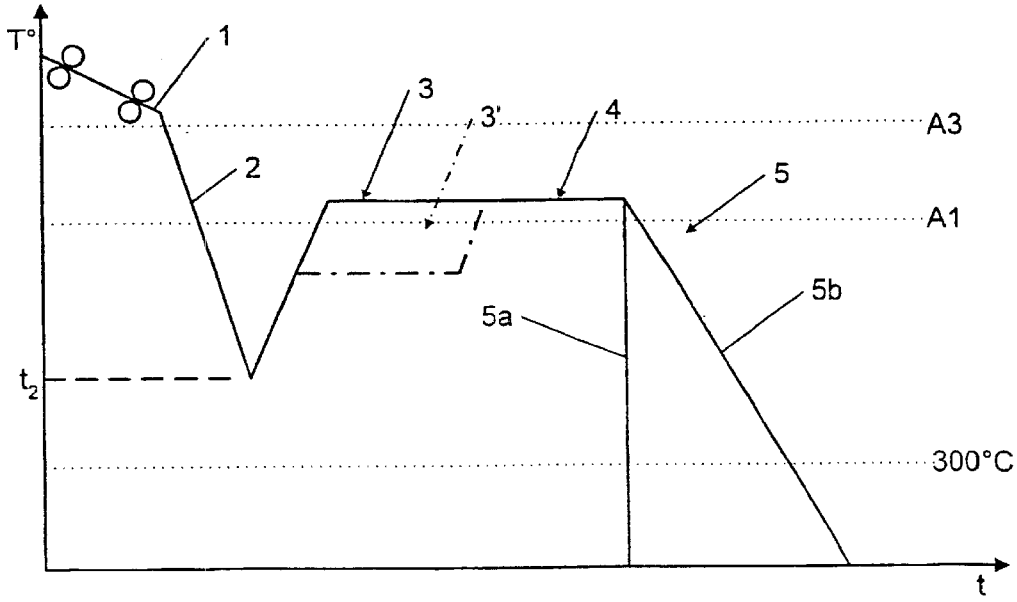

The fourth method of implementation, illustrated in FIG. 4, is distinguished from the third method of implementation by the fact that the hot rolling 1 is followed firstly by cooling 2 and by coiling at a temperature $t_2$, below the bainite formation start temperature, and then immediately by the tempering 3, especially by "bell" annealing, of the black, i.e. unpickled, coil. The pickling may take place after the cooling 5.

Figure 5:
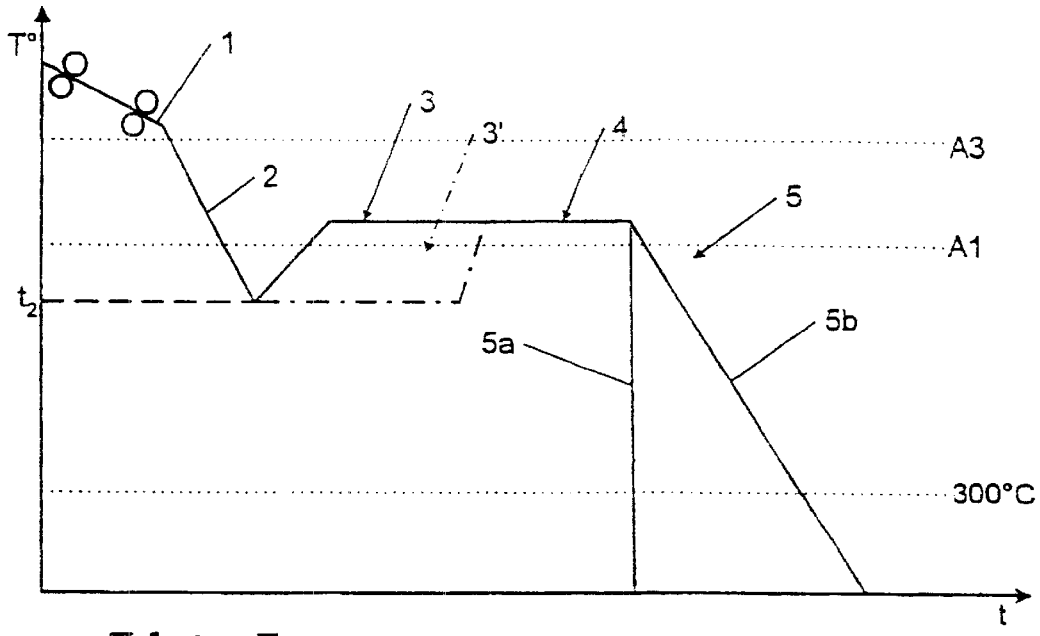

The fifth method of implementation, illustrated in FIG. 5, is distinguished from the previous one by the fact that the coiling, after the hot rolling 1, takes place at a temperature $t_2$ for which the microstructure is composed of ferrite-pearlite or ferrite-pearlite-bainite.

As a variant to the methods of implementation in FIGS. 4 and 5, it is possible, as in the second method of implementation and as indicated by the broken lines 3' in these FIGS. 4 and 5, to carry out the tempering 3 at a temperature below the temperature $A_1$.

The sixth method of implementation, illustrated by FIG. 6, differs from the previous one by the fact that, on the one hand, the coiling of the sheet, after the hot rolling, takes place at a temperature above the temperature $A_1$ and below the temperature $A_1$+50° C., so as to retain a fraction of untransformed austenite and that, on the other hand, this coiling is followed by a soak substantially at this temperature under an isolating bell for at least 4 hours in order to enrich the untransformed austenite with gammagenic elements, such as manganese and/or boron.

The aforementioned methods of implementation make it possible to obtain a hot-rolled (HR) product which can have several types of microstructure, the nature of which depends on the chemical composition of the austenite formed and on the final cooling rate (TRC diagram). This is therefore a ferrite matrix with islands of at least one of the following phases: residual austenite, bainite and/or martensite.

Advantageously, the hot-rolled steel may also undergo, as already mentioned above, after pickling either in an acid bath or by annealing in a reducing atmosphere, a galvanizing and/or electrochemical metallization step, so as to obtain a galvanized or zinc-plated steel sheet, for example.

The methods of implementing the process according to the invention which are illustrated schematically by the graphs in FIGS. 7 to 15 relate to a coil which has undergone cooling down to approximately room temperature, possibly followed by cold rolling with, for example, a reduction ratio of between 40% and 90%.

Figure 7:
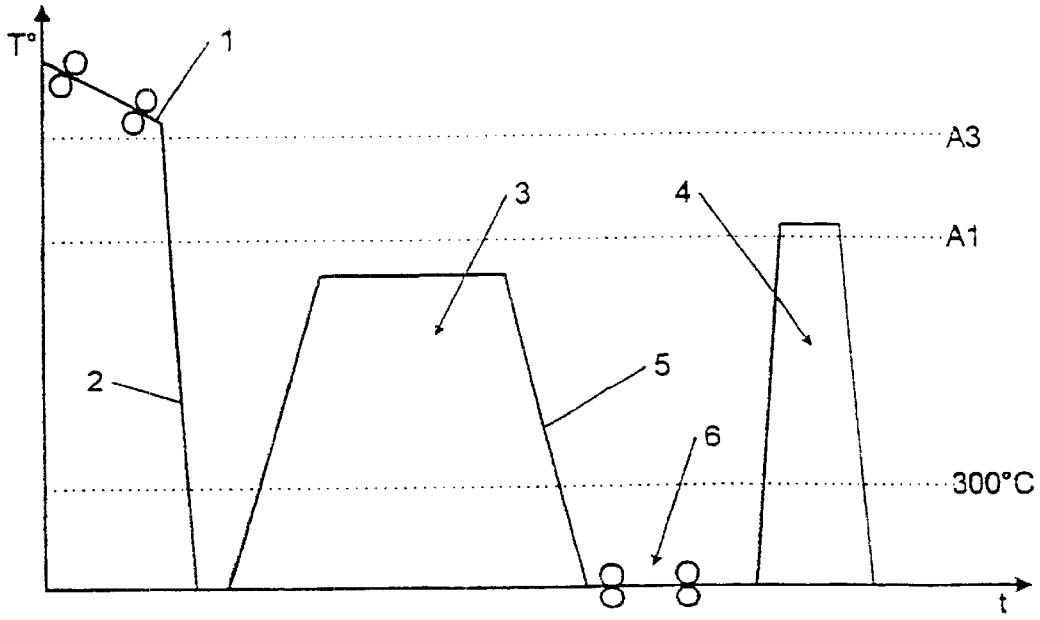

Thus, the seventh method of implementation, according to FIG. 7, is distinguished from that in FIG. 1 by the fact that so-called "slow" or "quench-accelerated" cooling 5, possibly with conventional cold rolling 6, is inserted between the tempering 3 and the heat treatment 4, which, in this method of implementation, consists of intercritical continuous annealing.

During this cold rolling 6, a thickness reduction ratio of the sheet between 40 and 90% and a work-hardened microstructure, which recrystallizes during the subsequent annealing 4, are generally obtained. If such cold rolling is provided, this is preceded by pickling which may be carried out before or after the tempering operation 3.

It should also be pointed out that the sheet subjected to the cold rolling 5 essentially consists, before the annealing 4, of ferrite and of cementite rich in carbide-forming elements, such as Mn, Cr, Mo, and/or B.

Figure 8:
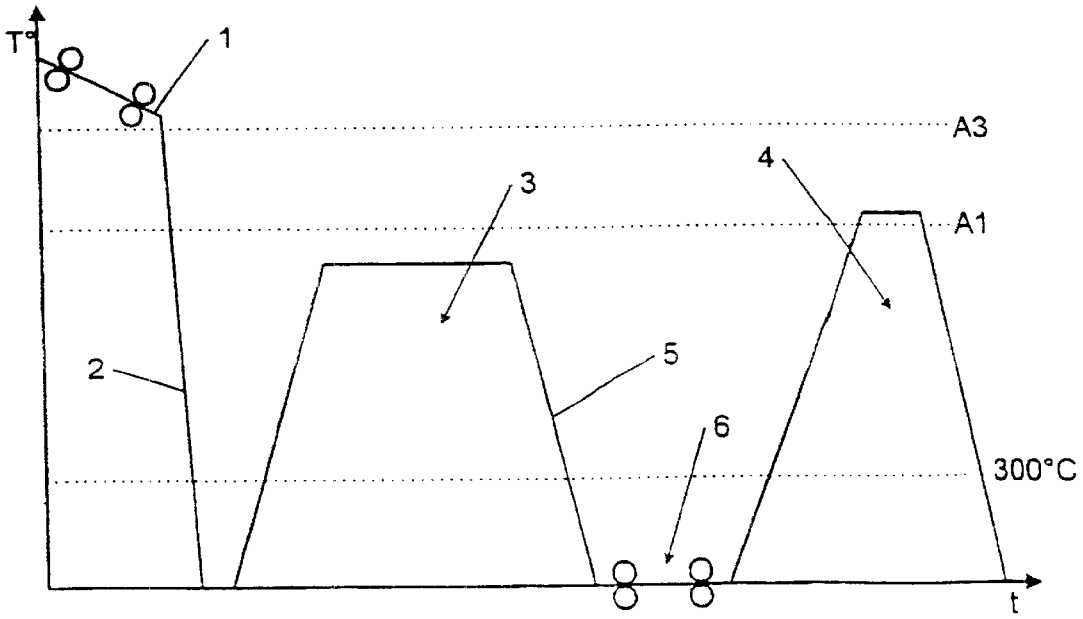

The method of implementation according to FIG. 8 is a variant of the previous one, which is distinguished therefrom by the fact that the heat treatment 4 consists of discontinuous intercritical annealing, also called "bell intercritical annealing".

Figure 9:
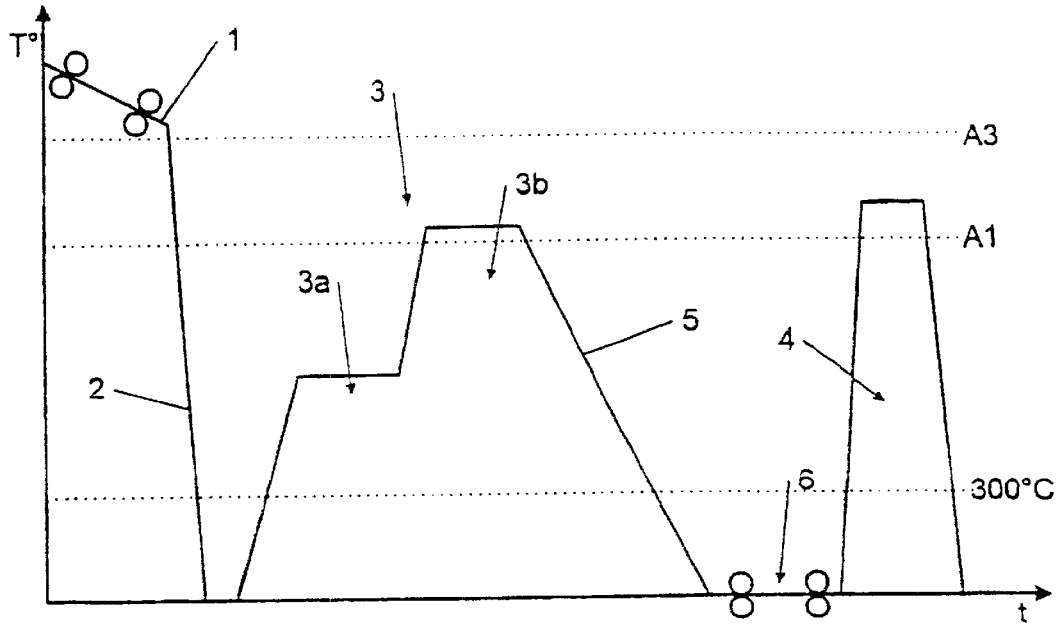
Figure 10:
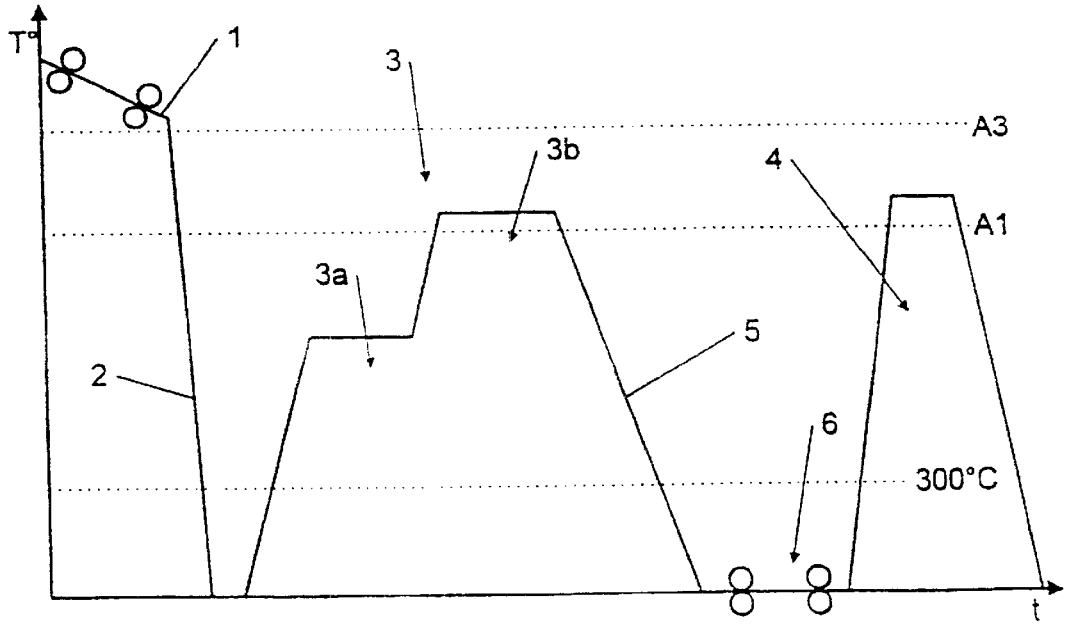

The methods of implementation according to FIGS. 9 and 10 are distinguished from that in FIG. 8 by the fact that the tempering 3 is split into partial tempering 3*a* at a temperature below the temperature $A_1$ and tempering 3*b* between the temperature $A_1$ and the temperature $A_1$+50° C. In the method of implementation according to FIG. 9, the heat treatment 4 is continuous intercritical annealing, whereas in the method of implementation according to FIG. 10 it is intercritical annealing by bell annealing.

Figure 11:
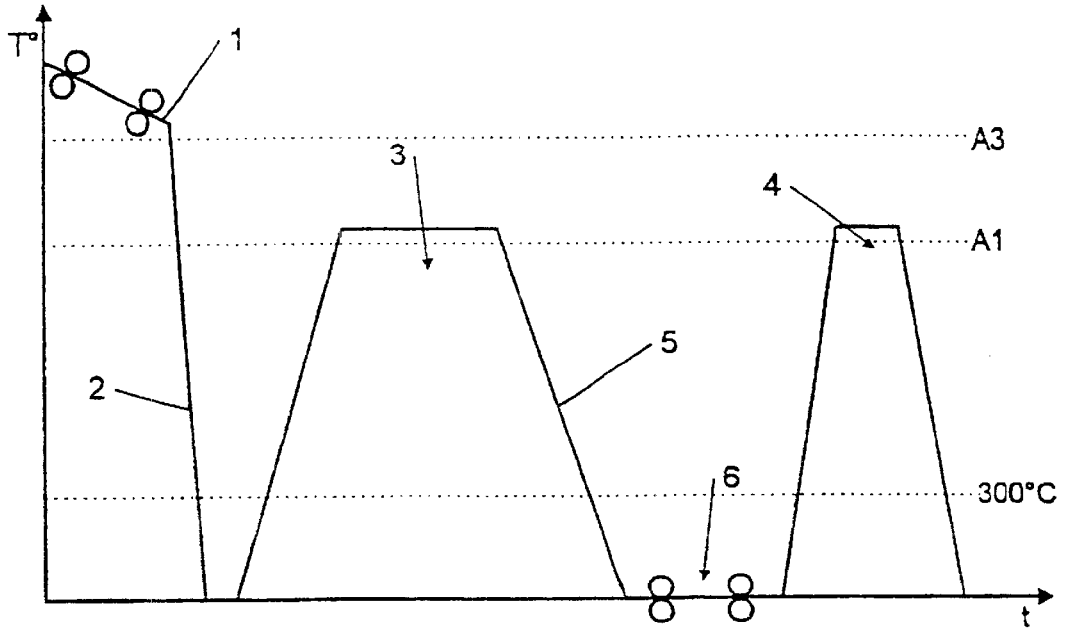
Figure 12:
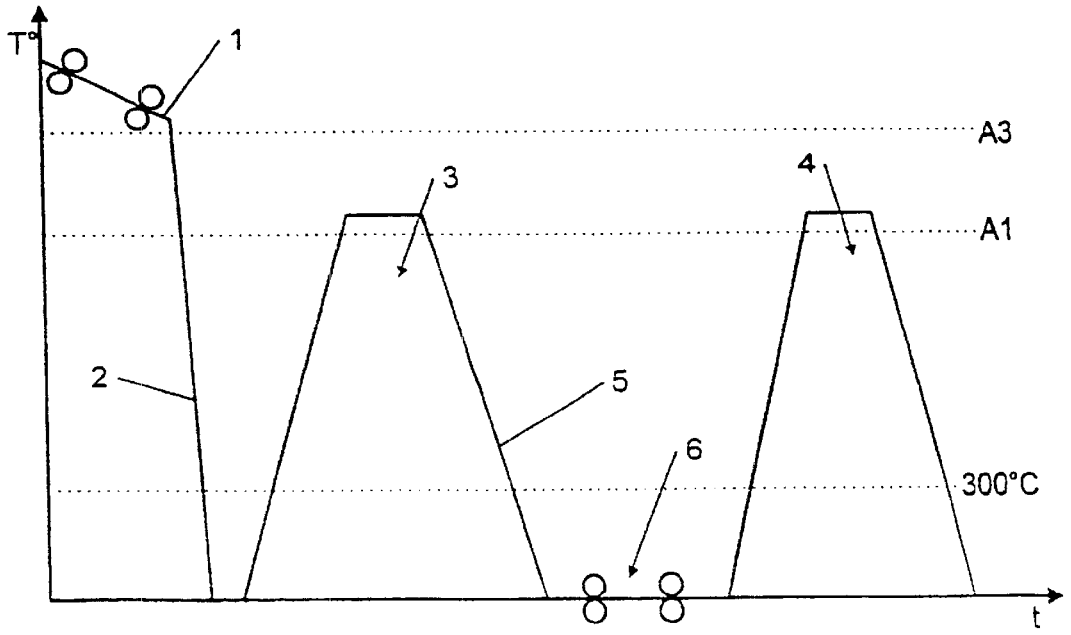

The two methods of implementation according to FIGS. 11 and 12 are distinguished from the previous methods of implementation by the fact that both the tempering 3 and the heat treatment 4 take place at a temperature above the temperature $A_1$ and that, in addition, these two operations 3 and 4 are separated by cooling 5 and cold rolling 6.

In the method of implementation according to FIG. 11, there is continuous intercritical annealing 3 and in that in FIG. 12 there is intercritical annealing by bell annealing 3.

In both these methods of implementation, the austenite formed is enriched with so-called "gammagenic" elements, such as Mn, B and/or C, during the annealing 3.

In the method of implementation illustrated in FIG. 13, the hot rolling 1 is followed by slight cooling 2 and by coiling below the temperature $A_1$ and above the bainite formation start temperature $t_2$ in order to obtain a ferrite-pearlite microstructure. This temperature of the coil is then maintained by thermal isolation under a bell for at least 4 hours, as in the method of implementation illustrated in FIG. 6.

Figure 14:
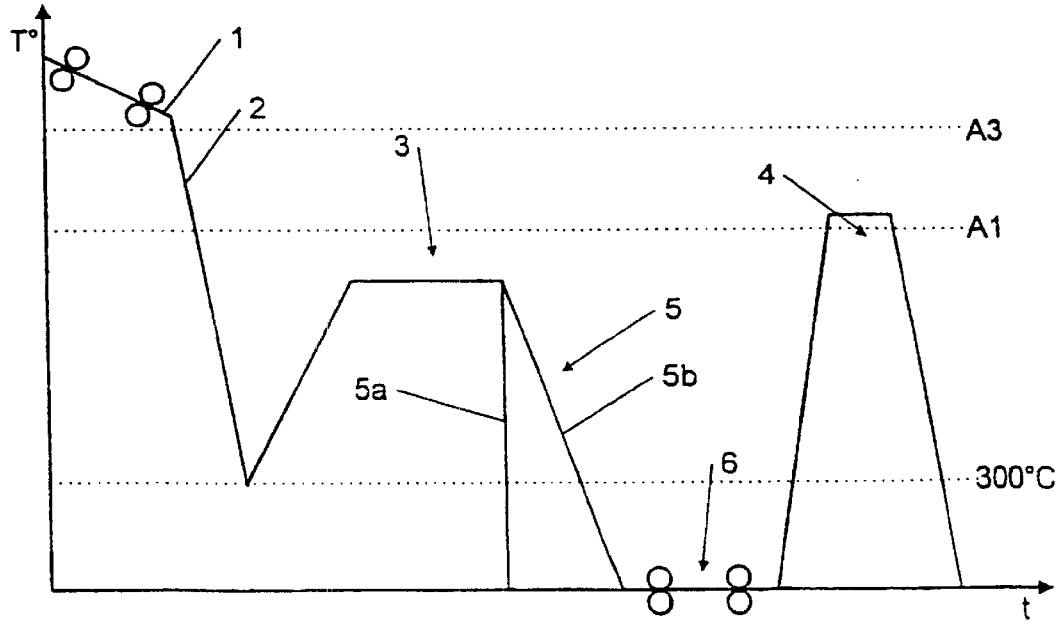

The method of implementation according to FIG. 14 is comparable to that in FIG. 4, or to that in FIG. 5, with the exception that so-called "slow" or quench-accelerated cooling 5, possibly with cold rolling 6, is provided between the tempering 3 and the heat treatment 4. The heat treatment 4 may be carried out by continuous intercritical annealing or by bell intercritical annealing.

Figure 13:
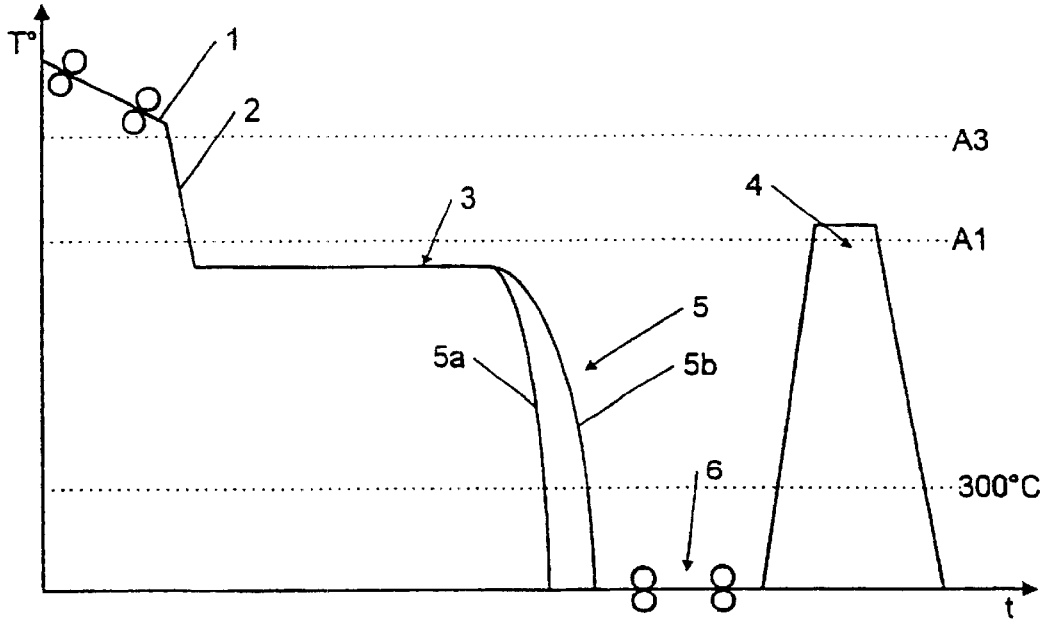
Figure 15:
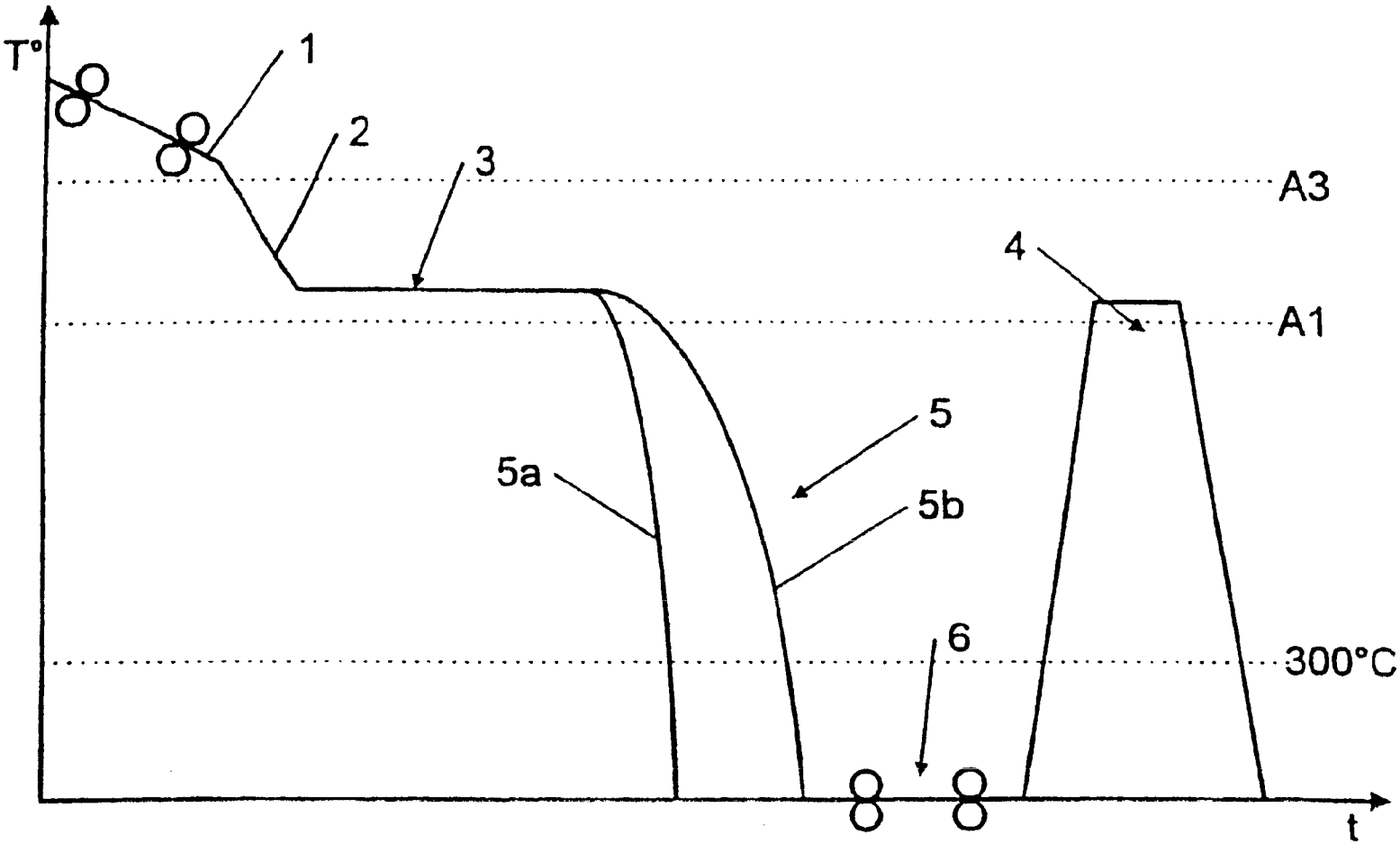

The method of implementation according to FIG. 15 is distinguished from that in FIG. 13 by the fact that the hot rolling 1 is immediately followed by a soak in an isolating bell at a temperature of between the temperature $A_1$ and the temperature $A_1$+50° C. in order to keep some untransformed austenite in the microstructure.

In the methods of implementation illustrated by the various figures, when the heat treatment 4 consists of continuous intercritical annealing, this generally takes place at a temperature of between the temperature $A_1$ and 900° C. for 1 second to 5 minutes, possibly combined either with dip metallization, or followed by metallization by electrochemical deposition. If the heat treatment 4 consists of bell intercritical annealing, this preferably takes place at a temperature lying between the temperature $A_1$ and 50° C. above this temperature.

It has turned out that the steel obtained according to the process described above, more particularly according to the particular methods of implementation illustrated in FIGS. 1 to 15, has in particular the following properties:

- better surface quality and suitability for galvanizing compared with multiphase steels containing Si;
- a good yield stress/tensile strength ratio;
- good forming properties and a high uniform elongation;
- an increase in the yield stress and in the tensile strength by the effect of secondary precipitation of the microalloying elements during the tempering compared with conventional multiphase steels;
- a high work-hardening coefficient during deformation;
- anti-necking protection, by virtue of the high n values and a high uniform elongation;
- a low or nonexistent yield point elongation, allowing low skin-pass elongations;
- good mechanical fatigue behavior by a combination of hard phases, formed from bainite and martensite, and of soft phases, formed from ferrite and residual austenite;
- a high value of energy absorption during deformation at high rates, as a result of dislocation multiplication mechanisms.

In order to allow the subject matter of the present invention to be illustrated in greater detail, a few specific examples of chemical compositions of a multiphase steel according to the invention, and of parameters of the various production steps applied to this steel, will be given below.

EXAMPLE 1

This example was produced according to the particular method of implementing the process illustrated by the graph in FIG. 7.

Chemical Composition:

0.16% C
1.60% Mn
0.40% Si

1) Reheat: temperature: 1280° C.
time: 150 minutes
2) Rough rolling: final temperature: 1100° C.
(1st step)
3) Finish rolling: final temperature: 850° C.
4) Runout table: cooling rate: 50° C./s
5) Coiling temperature: less than 400° C., natural air cooling
6) Pickling:
7) Bell annealing: (2nd step)
heating rate: 40° C./h
soak temperature: 640° C.
soak time: 40 h
cooling rate: 15° C./h
8) Cold rolling:
reduction ratio: 60%
9) Continuous annealing: (3rd step)
heating rate: 15° C./s
soak temperature: 740° C.
soak time: 50 s
cooling rate: 40° C./s
skin-pass elongation: 0.2%
10) Galvanizing by passing through a bath of liquid zinc.

Figure 16:
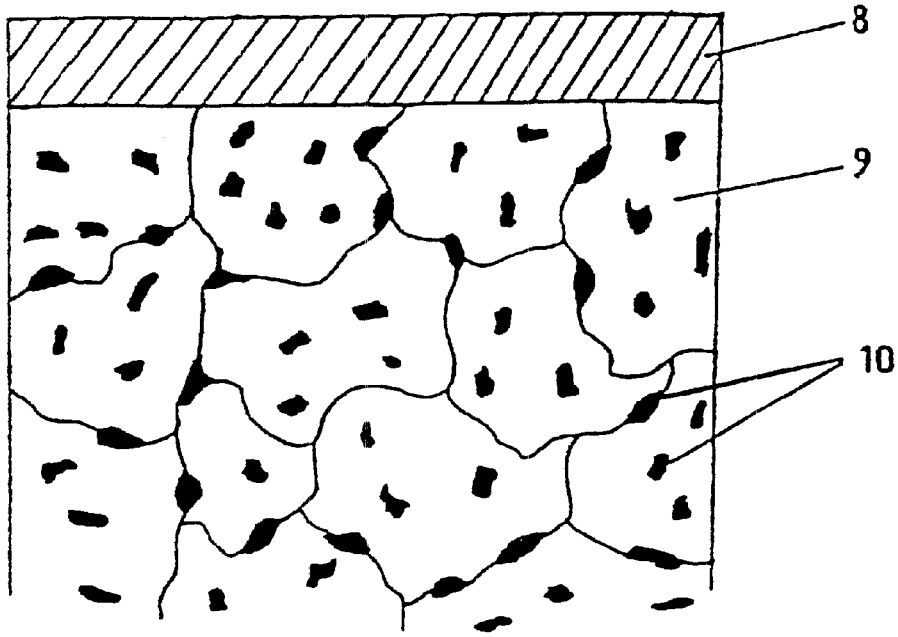
FIGS. 16 to 18 are schematic representations of a cross section through various microstructures of the steel according to the invention.

FIG. 16 shows schematically a cross section of the steel according to this example provided with a zinc coating 8 obtained by galvanizing. This steel comprises a ferrite matrix 9 in which islands 10 of residual austenite approximately equal in size are approximately uniformly distributed.

Mechanical properties obtained in an industrial test on a sheet specimen 1.5 mm in thickness taken with the axis of the sheet in the rolling direction and subjected to a tensile test according to the ISO standard with a test piece having a base of 80 mm and a width of 20 mm:

Yield stress $R_{p0.2}$% (MPa): 370
Tensile strength $R_m$ (MPa): 580
$R_{p0.2}$%/$R_m$ ratio (%): 63.8
Yield point elongation (%): 1.1
Uniform elongation (%): 18.8
Total elongation (%): 31.2
Work-hardening coefficient n: 0.262
Anisotropy coefficient r: 1.32.

EXAMPLE 2

This example was produced according to the particular method of implementing the process illustrated by the graph in FIG. 7.

Chemical Composition:

0.170% C
1.800% Mn
0.020% Ti
0.080% V
0.003% B

1) Reheat at 1280° C. for 150 minutes
2) Rough rolling:final temperature of 1100° C.
3) Finish rolling: final temperature of 910° C. down to a thickness of 2.0 mm
4) Runout table: cooling rate of 50° C./s
5) Coiling temperature: 350° C., air-cooling of the coil down to room temperature
6) Conventional pickling, i.e. with the coil unwound in hot HCl
7) Base annealing: temperature rise of 40° C./h
soak temperature of 520° C.
soak time of 40 h
cooling rate of 15° C./h down to
room temperature 8) Cold rolling with a reduction ratio of 60%
9) Continuous annealing:temperature rise of 15° C./s
soak temperature of 820° C.
soak time of 46 s
cooling rate of 30° C./s
skin-pass level of 0.6%
10) Metallization: conventional galvanizing combined with continuous annealing.

The mechanical properties obtained in an industrial test on a sheet specimen 1.5 mm in thickness taken with the axis of the sheet in the rolling direction and subjected to 20/80 tensile testing (ISO standard) are as follows:

Yield stress $R_{p0.2}$% (MPa): 471
Tensile strength $R_m$ (MPa): 649
$R_{p0.2}$%/$R_m$ ratio (%): 72.6
Yield point elongation (%): 1.0
Uniform elongation (%): 14.1
Total elongation (%): 28.3
Work-hardening coefficient n: 0.221

Figure 17:
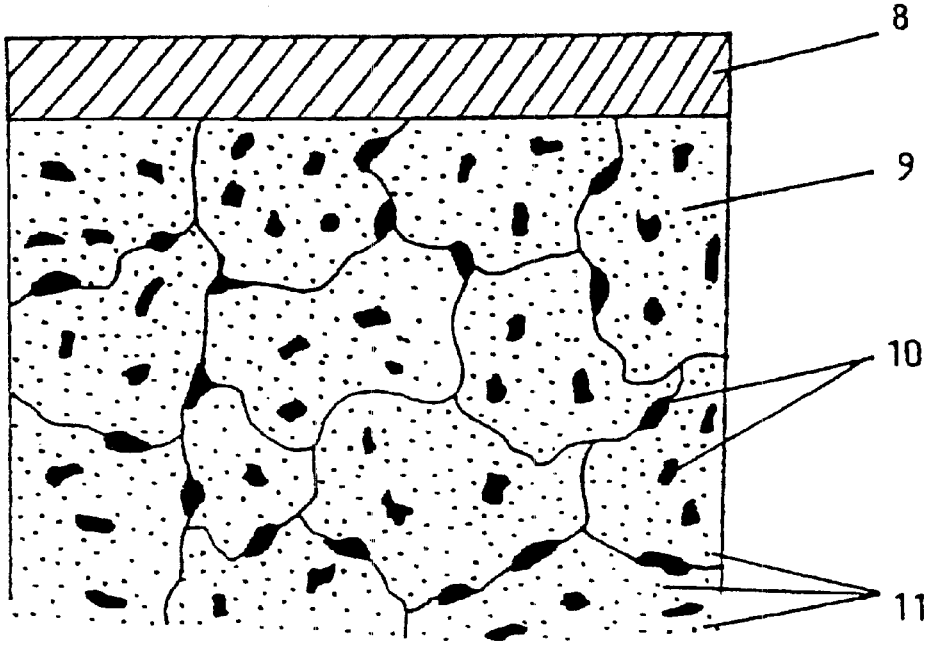

FIG. 17 shows schematically the structure of the steel obtained according to this example provided with a zinc coating 8 formed by galvanizing. This steel has a ferrite matrix 9 in which islands 10 of residual austenite and vanadium carbide precipitates 11 are approximately uniformly distributed.

EXAMPLE 3

Figure 6:
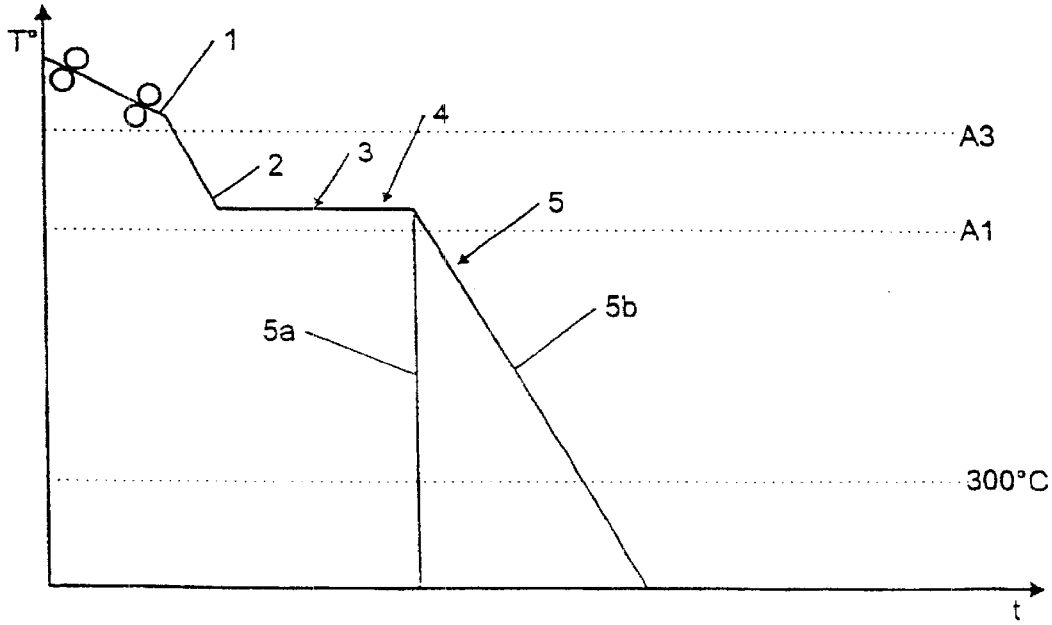

This example was produced according to the particular method of implementing the process illustrated by the graph in FIG. 6.

Chemical Composition:

0.150% C
2.000% Mn
0.030% B

Figure 18:
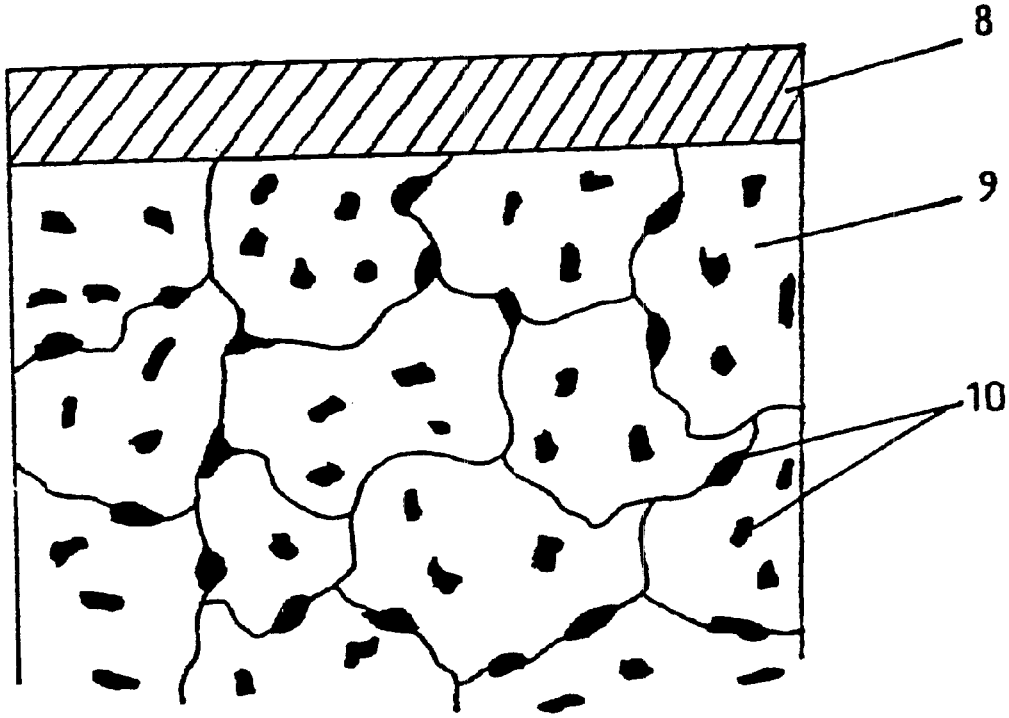

1) Reheat at 1280° C. for 150 minutes
2) Rough rolling: final temperature of 1100° C.
3) Finish rolling:final temperature of 840° C. down to a thickness of 6.0 mm
4) Runout table: cooling rate of 15° C./s
5) Coiling temperature: 740° C., maintained by isolating bell
6) Isolating bell: soak temperature of 740° C.
soak time of 40 h
accelerated-cooling rate of
5° C./s FIG. 18 shows schematically the structure of the steel obtained according to this example provided with a film of millscale 8. This steel has a ferrite matrix 9 in which islands 10 of martensite and of residual austenite are approximately uniformly distributed.

Of course, the invention is not limited to the method of implementing the particular process for producing a steel but, on the contrary, encompasses any steel having approximately the same structure and morphology as the multiphase steel obtained by the specific process described above and illustrated by the appended figures.

What is claimed is:

1. A flat product made of multiphase steel whose chemical composition contains carbon and manganese, wherein said steel has a structure obtained by a process comprising:

hot-rolling, at a temperature above the austenite transformation temperature ($A_3$), of a steel containing in wt % 0.05 to 0.8% C, 0.2 to 3.0% Mn, Si≦1%, B≦0.100%, Ti, Nb, Zr and V each ≦0.200%, Al≦0.400%, N≦0.100%, P≦0.100%, Cr, Ni and Cu each ≦2.000%, Mo≦0.500%, the balance being Fe and inevitable impurities;

soaking or tempering at a temperature of between 300° C. and a temperature 50° C. above the eutectoid temperature ($A_1$) for at least 4 hours, so as to form a phase enriched in carbide-forming and/or gammagenic elements in a ferrite matrix;

heat treating at a temperature above the aforementioned eutectoid temperature ($A_1$) and below the austenite transformation temperature ($A_3$) so as to form islands of austenite enriched with at least one of said carbide-forming and gammagenic elements and/or to enrich the austenite already formed with at least one of said carbide-forming and gammagenic elements; and subsequently cooling down to room temperature in such a way as to obtain a final product having a ferrite matrix containing islands of residual austenite enriched with said carbide-forming and/or gammagenic elements.

2. The product as claimed in claim 1, wherein said process comprises pickling after the hot rolling.

3. The product as claimed in claim 1, wherein said process comprises pickling after said soaking or tempering at a temperature of between 300° C. and a temperature 50° C. above the eutectoid temperature ($A_1$) or after the aforementioned heat treatment.

4. The product as claimed in claim 2, wherein said process comprises cooling, after the hot rolling, at a rate and down to a temperature below the temperature $A_1$ to obtain a microstructure containing at least one of bainite, martensite, and pearlite.

5. The product as claimed in claim 1, wherein when said hot rolling makes it possible to obtain a reelable sheet, said hot rolling is followed by coiling of the flat product obtained at a temperature between the eutectoid temperature ($A_1$) and a temperature 50° C. above this eutectoid temperature, so as to maintain some untransformed austenite in the microstructure obtained.

6. The product as claimed in claim 1, wherein the steel undergoing the aforementioned hot rolling contains at the very most 0.5 wt % Si.

7. The product as claimed in claim 6, wherein the elements Al, N, B have the following concentrations, respectively: Al≦0.100%; N≦0.05%; B≦0.060%; Ti, Nb, Zr or V each ≦0.100%; Cr≦0.500%.

8. The product as claimed in claim 1, having a ferrite matrix containing islands of residual austenite, the content of this phase in the ferrite matrix being less than 40% by volume.

9. The product as claimed in claim 1, wherein the aforementioned process comprises cooling down to room temperature after the aforementioned soaking or tempering.

10. A process for the manufacture of a flat product made of steel, as claimed in claim 1, comprising:

hot rolling, at a temperature above the austenite transformation temperature ($A_3$), of a steel containing in wt % 0.05 to 0.8% C, 0.2 to 3.0% Mn, Si≦1%, B≦0.100%, Ti, Nb, Zr and V each ≦0.200%, Al≦0.400%, N≦0.100%, P≦0.100%, Cr, Ni and Cu each ≦2.000%, Mo≦0.500%, the balance being Fe and inevitable impurities;

soaking or tempering at a temperature of between 300° C. and a temperature 50° C. above the eutectoid temperature ($A_1$) for at least 4 hours, so as to form a phase enriched with gammagenic and/or carbide-forming elements in a ferrite matrix;

heat treating above the aforementioned eutectoid temperature ($A_1$) and below the austenite formation temperature ($A_3$) so as to form islands of austenite enriched with at least one of said carbide-forming and gammagenic elements and/or to enrich the austenite already formed with at least one of said carbide-forming and gammagenic elements; and subsequently cooling down to room temperature in such a way as to obtain a final product having a ferrite matrix containing islands of residual austenite enriched with at least one of said carbide-forming and gammagenic elements.

11. The process as claimed in claim 10, wherein the aforementioned tempering is carried out at a temperature below the eutectoid temperature ($A_1$) so as to form cementite and to make carbide-forming elements diffuse into said cementite.

12. The process as claimed in claim 10, wherein the aforementioned tempering is carried out at a temperature above the eutectoid temperature ($A_1$) so as to form austenite and to make gammagenic elements diffuse into this austenite.

13. The process as claimed in claim 10, wherein the aforementioned tempering is followed, before the aforementioned heat treatment, by cooling down to room temperature in such a way as to reduce the rate of enrichment of the phase already enriched with gammagenic and/or carbide-forming elements.

14. The process as claimed in claim 12, wherein the heat treatment consists of continuous annealing at a temperature of at most 900° C. for at most 5 minutes, so as to transform the phase enriched with at least one of gammagenic and carbide-forming elements into austenite, the chemical composition of which corresponds approximately to that of the phase enriched with at least one of gammagenic and carbide-forming elements, this annealing then being followed by rapid cooling.

15. The process as claimed in claim 10, wherein the aforementioned tempering is followed directly, without any intermediate cooling, by said heat treating including bell annealing for at least 2 hours, in such a way as to transform the cementite into austenite, this heat treating then being followed by cooling.

16. The process as claimed in claim 10, comprising cooling between the hot rolling and said soaking or tempering.

17. The process as claimed in claim 13, wherein the aforementioned cooling after tempering is followed by cold rolling before said heat treatment.

18. The process as claimed in claim 10, wherein the heat treating includes bell annealing followed by slow cooling.

19. The process as claimed in claim 11, wherein the cold rolling is followed by annealing at a temperature of between the eutectoid temperature ($A_1$) and the austenite transformation temperature ($A_3$), this annealing then being followed by rapid cooling.

20. The process as claimed in claim 10, wherein the aforementioned tempering is carried out in two successive stages, a first stage at a temperature between 300° C. and the eutectoid temperature ($A_1$) and a second stage at a temperature of between the eutectoid temperature ($A_1$) and a temperature 50° C. above this temperature $A_1$.

21. The process as claimed in claim 10, wherein the aforementioned tempering or soaking and the aforementioned heat treating are carried out in a single operation between a temperature $A_1$ and 50° C. above temperature $A_1$.

22. The process as claimed in claim 10, wherein the hot rolling is directly followed by the tempering either at a temperature above the temperature $A_1$ and below the temperature $A_1$+50° C. or at a temperature below the temperature $A_1$.

23. The process as claimed in claim 10, comprising between the hot rolling and the aforementioned soaking or tempering, cooling and coiling either at a temperature at which the microstructure is composed of bainite and/or martensite, or at a temperature below the temperature $A_1$ at which the microstructure is composed of ferrite/pearlite or ferrite/pearlite/bainite.

24. The process as claimed in claim 10, wherein the heat treating is one of combined with and followed by forming a metal coating.

25. The process as claimed in claim 13, wherein the heat treatment consists of continuous annealing at a temperature of at most 900° C. for at most 5 minutes, so as to transform the phase enriched with gammagenic and/or carbide-forming elements into austenite, the chemical composition of which corresponds approximately to that of the phase enriched with gammagenic and/or carbide-forming elements, this annealing then being followed by rapid cooling.

26. The product of claim 1, wherein said process comprises cooling down to room temperature after the hot-rolling and before the soaking or tempering.

27. The product of claim 1, wherein the steel undergoing the aforementioned hot rolling contains less than 0.2 wt % Si.

28. The product of claim 1, wherein the steel undergoing the aforementioned hot rolling does not contain any Si.

29. The product of claim 9, wherein the cooling down to room temperature is followed by a cold rolling before the aforementioned heat treating.

30. The process of claim 14, wherein the annealing is followed by a cooling at a rate of about 10° C. to 300° C. per second.

31. The process of claim 15, wherein the heat treating is followed by a cooling at a rate of about 10° C. to 40° C. per hour.

32. The process of claim 15, wherein the heat treating is followed by a quench-accelerated cooling.

33. The process of claim 13, wherein the aforementioned cooling is followed by pickling before said heat treating.

34. The process of claim 10, wherein the heat treating includes bell annealing followed by quench-accelerated cooling.

35. The product of claim 1, wherein the carbide-forming and/or gammagenic elements are manganese, boron, molybdenum and/or chromium.

36. The process of claim 10, wherein the carbide-forming and/or gammagenic elements are manganese, boron, molybdenum and/or chromium.

* * * * *